US005421444A

United States Patent [19]

Wildman

[11] Patent Number: 5,421,444

[45] Date of Patent: Jun. 6, 1995

[54] TOY DISK OPERATED MECHANISM

[75] Inventor: John R. Wildman, North Riverside, Ill.

[73] Assignee: Meyer/Glass Design, Chicago, Ill.

[21] Appl. No.: 195,325

[22] Filed: Feb. 10, 1994

[51] Int. Cl.[6] ..... G07D 5/02; A45C 1/12

[52] U.S. Cl. ..... 194/243; 194/248; 194/337; 446/10

[58] Field of Search ..... 194/212, 243, 248, 252, 194/257, 259, 300, 334, 337; 446/8, 9, 10

[56] References Cited

U.S. PATENT DOCUMENTS

| | | | |
|---|---|---|---|
| 3,023,928 | 3/1962 | Etes | 194/257 X |
| 3,371,761 | 3/1968 | Hirano | 194/334 X |
| 4,673,368 | 6/1987 | Bush | 194/334 X |
| 4,998,611 | 3/1991 | Shuie | 194/334 X |

*Primary Examiner*—F. J. Bartuska

*Attorney, Agent, or Firm*—Dorn, McEachran, Jambor & Keating

[57] ABSTRACT

A disk actuated mechanism for a toy which accepts and responds to disks of different diameters. The mechanism can be adapted to a housing having a circular opening in the housing and a disk reservoir in the housing located below the circular opening. A shaft connects the opening and the disk reservoir. A disk carrier is mounted in the shaft for vertical movement from the opening towards a disk discharge position. A handle is connected to the disk carrier for moving the carrier to the disk discharge position. A mechanism engages a disk on the disk carrier to determine its diameter and provide an output indicative of its diameter. A detent mechanism is provided to prevent the handle from moving the disk carrier to the disk discharge position unless a disk is inserted in the disk carrier. Downward insertion of the disk into the disk carrier disengages the detent mechanism and allows the handle to move the disk carrier to the disk discharge position.

4 Claims, 2 Drawing Sheets

TOY DISK OPERATED MECHANISM

BACKGROUND AND SUMMARY OF THE INVENTION

This invention is directed to an imitation or coin substitute disk receiving apparatus for a toy which simulates the action of actual coin receiving mechanisms such as those found in vending machines, telephones and other coin operated apparatus.

An object of this invention is a toy disk receiving mechanism which can be built into children's toys and can be operated with plastic disks of various diameters.

Another object of this invention is a toy disk receiving mechanism which automatically adjusts to accept plastic disks of various diameters.

Yet another object of this invention is a toy disk receiving mechanism which determines the diameter of a plastic disk and can actuate a mechanism which provides a signal responsive to the actual diameter of the disk.

Still another object of this invention is an imitation, coin receiving mechanism which may be adapted to educational products which assists a child to learn colors, shapes, numbers and letters.

Other objects may be found in the following specification, claims and drawings.

BRIEF DESCRIPTION OF THE DRAWINGS

The invention is illustrated more or less diagrammatically and the following drawings wherein.

DESCRIPTION OF THE PREFERRED EMBODIMENT

Figure 1:
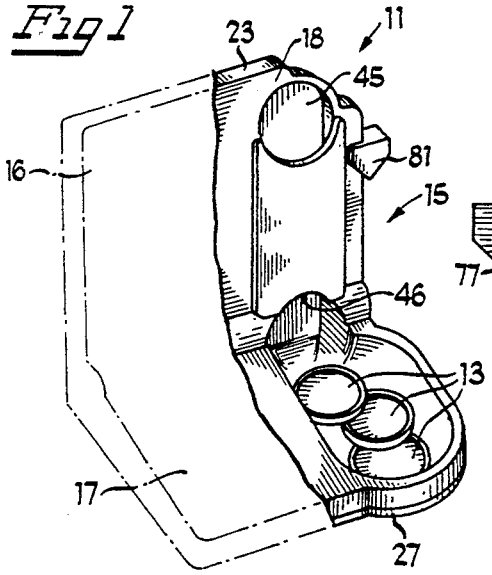
FIG. 1 is a perspective view of the mechanism of this invention incorporated in a toy with some parts of the toy omitted and others shown in phantom lines.

A disk receiving and sensing mechanism of this invention is shown in FIG. 1 of the drawings incorporated in a toy 11. The mechanism is adapted to handle plastic coin-like disks 13 of varying diameters. The mechanism can be built into a children's telephone 11 as shown diagrammatically in FIG. 1 or any other toy which requires a coin handling or coin actuated mechanism. The toy 11 is depicted in the shape of an L-shaped housing 15 having an upstanding portion 16 and a base portion 17. The upstanding portion 16 of the housing 15 includes a front wall 18, a rear wall 19 (FIG. 3), an edge wall 21 (FIG. 5) and a top wall 23 all formed of a thin plastic.

Figure 2:
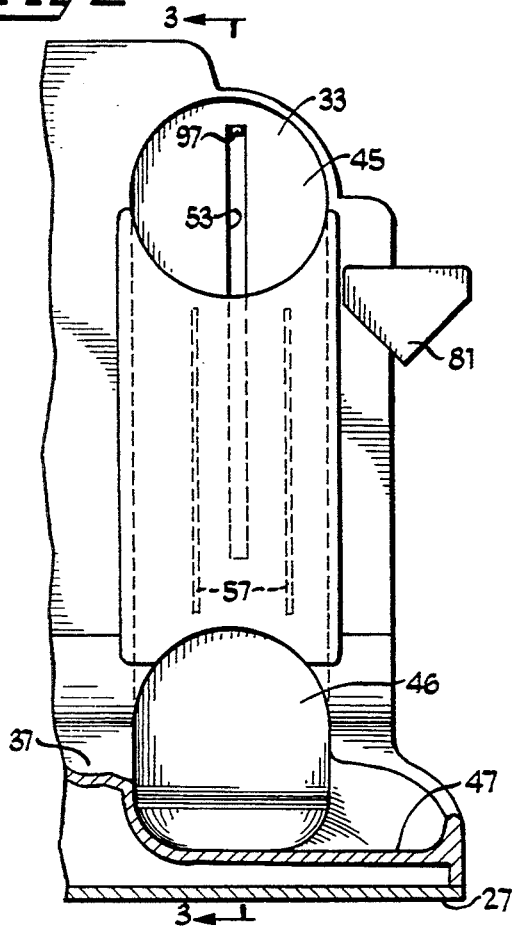
FIG. 2 is an enlarged partial front elevational view of the mechanism of FIG. 1 with some parts shown in cross section and others in dashed lines.
Figure 3:
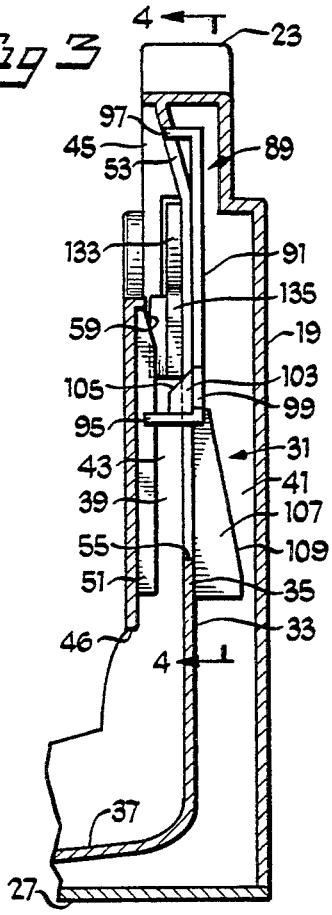
FIG. 3 is a cross sectional view taken along line 3—3 of FIG. 2.

The base portion 17 includes a bottom wall 27 as shown in FIGS. 1, 2 and 3. The upstanding portion 16 of the housing has a chamber 31 which is divided by a septum 33 (FIG. 3) having a vertical portion 35 and a horizontal portion 37. The septum divides the chamber 31 into a front compartment 39 and a rear compartment 41. The front compartment defines a shaft 43 which leads from a circular disk receiving opening 45 in the front wall 18 of the housing 15 through a disk discharge opening 46 to a coin reservoir 47 formed in the horizontal portion 37 of the septum 33.

A narrow vertical slot 53 is formed in the septum 33 and it enlarges to a rectangular passage 55 in the lower end of the septum as shown in FIGS. 3, 4, 5 and 6 of the drawings. Ribs 57 are formed on the interior surface of the front wall 18 of the upstanding portion 16 of the housing 15 with the ribs facing the vertical portion 35 of the septum 33. These ribs have tapered upper surfaces 59 to guide entry of a coin-like disk 13 into the shaft 43 as shown in FIGS. 3, 9 and 12 of the drawings.

Figure 4:
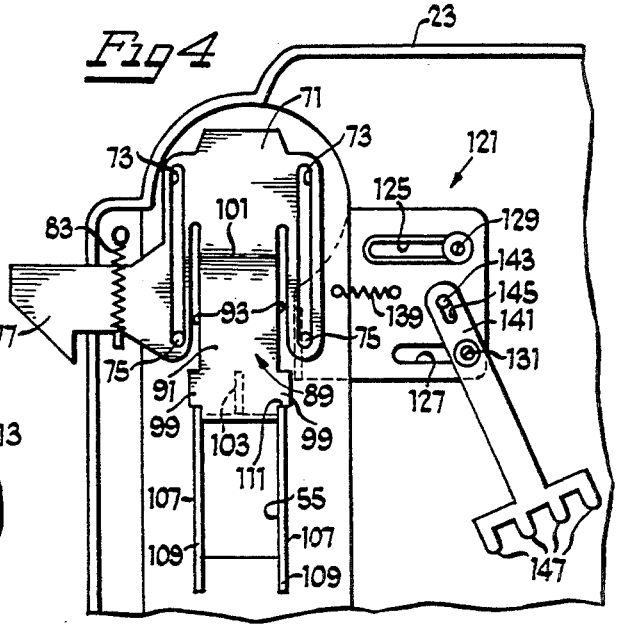
FIG. 4 is a partial view taken from the rear along line 4—4 of FIG. 3.
Figures 5, 6, 7, 8, 9, 10, 11, 12:
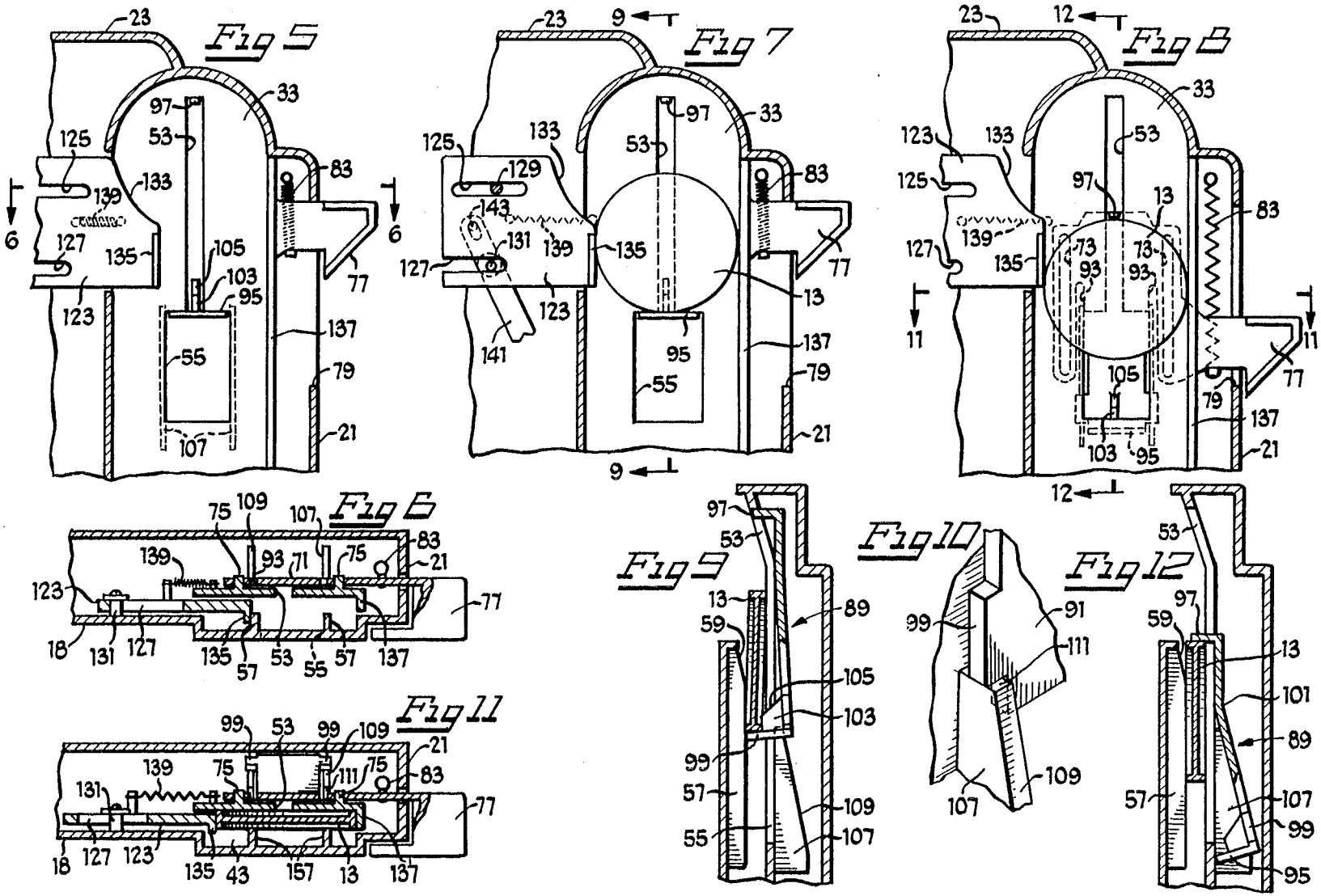
FIG. 5 is a cross sectional view taken from the front of the mechanism shown in FIG. 1 with parts broken away and others shown in cross section.
FIG. 6 is a partial cross sectional view taken along line 6—6 of FIG. 5.
FIG. 7 is a view similar to FIG. 5 showing a plastic disk inserted in the mechanism.
FIG. 8 is a view similar to FIGS. 5 and 7 and showing a disk in a lowered position.
FIG. 9 is a partial view taken along line 9—9 of FIG. 7.
FIG. 10 is an enlarged, partial, perspective view showing the disk carrier detent mechanism.
FIG. 11 is a cross sectional view taken along line 11—11 of FIG. 8.
FIG. 12 is a cross sectional view taken along line 12—12 of FIG. 11.

An irregularly shaped transfer plate 71 shown most clearly in FIG. 4 is mounted in the rear compartment 41 of the chamber 31 for vertical movement. The plate 71 includes guiding slots 73 formed therein which fit over posts 75 projecting rearwardly of the septum 33. A handle 77 is formed integrally with the transfer plate and extends out of the housing through a slot 79 formed in the edge wall 21. A pointer 81 is formed as part of the handle. A spring return 83 is provided to return the transfer plate 71 to its upper position as shown in FIGS. 4, 5 and 7 of the drawings.

The transfer plate 71 includes a coin carrier 89 formed by an elongated body portion 91 of the transfer plate. The body portion is defined by cutout slots 93 formed in the plate 71 inwardly of the guiding slots 73. A disk 13 support shelf 95 is formed at the bottom of the elongated body portion. A forwardly facing tab 97 is formed at the upper end of the transfer plate 71. The tab 97 rides in the vertical slot 53 in the septum 33 facing towards the front wall 18 of the upstanding portion 16 of the housing 15. Laterally extending ears 99 are formed at the bottom of the elongated body portion 91. A transversely extending, weakened bending line 101 is formed in the elongated body member and is most clearly shown in FIGS. 4 and 12 of the drawings. The body member bending line permits the lower portion of the elongated body portion 91, including the disk support shelf 95 to bend rearwardly to the position shown in FIG. 12.

A lug 103 is mounted on the disk support shelf 95 facing the front wall 18 of the upstanding portion 16 of the housing 15. A cam surface 105 for engaging a coin-like disk 13 is formed on the top of the lug 103. Ramps 107 are formed on the rear of the septum 33 on opposite lateral sides of the enlarged rectangular passage 55. These ramps have cam surfaces 109 which engage the ears 99 of the disk carrier 89 to bend the lower portion of the elongated body portion 91 rearwardly as the disk carrier is moved downwardly with its tab 97 engaging the disk as shown in FIG. 12. The ramps 107 terminate in flat top surfaces 111 which engage the ears 99 to prevent the previously described downward movement of the disk carrier 89 until the disk carrier is released. The disk carrier is released from detention by the ears 99 with the ramps 107 when a coin-like disk 13 inserted in the shaft 43 and pushed downwardly sufficiently far to engage the cam surface 105 of the lug 103 and force the ears 99 off the top surfaces 111 of the ramps and onto the cam surfaces 109 of the ramps 107 as shown in FIG. 9 of the drawings.

A mechanism 121 which senses and reacts to the specific diameters of the coin-like disks 13 includes an elongated plate 123. The elongated plate 123 is mounted for horizontal movement in the front compartment 39 of the chamber in directions towards and away from the disk carrier 89. The elongated plate is formed with horizontal slots 125 and 127 which ride on a guide pin 129 and a combination guide pin and pivot 131, respectively, which pins are mounted on the rear surface of the front wall 18 of the housing 15 as shown most clearly shown in FIGS. 4, 6, 7 and 8 of the drawings. The elongated plate 123 includes an arcuate end portion 133 which aligns with the circular opening 45 in the front wall 18 of the housing 15. A forwardly facing flange 135 is formed integrally with the elongated plate 123 at an end thereof to engage a coin-like disk 13 in the manner shown in FIG. 7 of the drawings. The disk is forced by flange 135 against a flange 137 formed on the septum 33 on the opposite side of the shaft 43, as shown in FIG. 6, to capture the disk between the flanges 135 and 137. The flange 137 of the elongated plate is biased against the coin-like disk 13 by a spring 139.

A wiper arm 141 is pivotally mounted on the guide pin and pivot 131 and is actuated by a drive pin 143 mounted on the elongated plate 123, which drive pin rides in an elongated slot 145 formed in the wiper arm. The opposite end of the wiper arm is shown in FIG. 4 and carries a conductor with a plurality of fingers 147 which engage pairs of contacts of electrical or electronic circuits mounted on circuit boards which are not shown because they are specific to the type of toy with which the disk receiving and sensing mechanism of this invention is used.

Although the coin-like disk 13 formed of plastic is only shown in one size in the drawings, the disk receiving and sensing mechanism of this invention is adapted to receive and react to disks 13 of various diameters within the range which will fit through the circular opening 45 which leads into the shaft 43. The various diameters of the disks can be coordinated with inputs from push buttons and selectors on the toys to provide a multiplicity of outputs for each disk.

The unloaded position of the disk carrier 89 is shown in FIG. 5 of the drawings. The disk sensing plate 123 is in its far right position under the influence of the spring 139 as shown in FIGS. 5 through 8 and 11 of the drawings. When a coin-like disk 13 is inserted through the opening 45, it must be pushed downwardly until it engages and rests on the shelf 95 of the disk carrier 89. As the disk is inserted and pushed down, it will engage the cam surface 105 on the lug 103 and bend the lower portion of the disk carrier 89 rearwardly about its weakened line 101 until its ears 99 are moved off the top surfaces 111 of the ramps 107 and into position to ride on the cam surfaces 109 of the ramps 107. The flange 135 on the disk sensing plate 123 will move into contact with the disk forcing it into contact with the flange 137 of the septum. When the handle 77 is pushed downwardly, the disk 13 will remain in the position shown in FIGS. 7 and 12 in contact with the ribs 57 until the tab 97 at the top of the disk carrier 89 engages the upper edge of the disk and forces it down through the shaft 43 into the vault 47. The downward movement of the disk carrier also causes its ears 99 to ride on the cam surfaces 109 of the ramps 107 moving the shelf 95 rearwardly out of the shaft 43 so it does not interfere with the downward progress of the disk.

The lateral movement of the disk sensing elongated plate 123 causes the wiping arm 141 to rotate about its pivotal connection 131 and causing its wiper to contact one of the electrical or electronic contacts (which are not shown) to thereby indicate the diameter of the disk. Although not part of this invention, the electrical or electronic contacts can be connected to any type of signalling mechanism to indicate the diameter of the disk which was inserted. Upon release of the handle 77, its spring 83 will return it to its initial position shown in FIG. 5 of the drawings where it is ready to accept another disk 13.

I claim:

1. A disk actuated mechanism for a toy including:

a housing, a circular opening leading into said housing, a disk reservoir formed in said housing below said circular opening, a shaft connecting said circular opening and said disk reservoir, a disk carrier mounted in said shaft for vertical movement from a disk receiving position adjacent said circular opening to a disk discharge position located below said circular opening, a handle connected to said disk carrier for moving said disk carrier to said disk discharge position, means to sense the diameter of said disk located on said disk carrier and to provide an output indicative of the diameter of said disk, and means to discharge said disk from said disk carrier when said handle moves said disk carrier to its disk discharge position.

2. The disk actuated mechanism of claim 1 in which said means to sense the diameter of said disk located on said disk carrier includes a plate mounted for linear movement into and out of contact with a disk, means to bias said plate into contact with a disk, and said means to provide an output indicative of the diameter of said disk includes an arm mounted on said plate for pivotal movement upon linear movement of said plate.

3. The disk actuated mechanism of claim 2 in which said arm has a conductor mounted on its distal end and said conductor has a plurality of fingers for engaging electrical and electronic contacts as said arm is pivoted by linear movement of said plate.

4. A disk actuated mechanism for a toy including:

a housing, a circular opening leading into said housing, an opening leading out of said housing, a shaft connecting said openings, a disk carrier mounted in said shaft for vertical movement from a disk receiving position adjacent said circular opening to a disk discharge position, said disk carrier including ears on the sides thereof, a handle connected to said disk carrier for moving said disk carrier to said disk discharge position, a detent means to prevent said handle from moving said disk carrier to said disk discharge position, said detent means including a pair of ramps with each ramp having a ledge at the top thereof, said ears engaging said ledges to detain downwardly movement of said disk carrier to said disk discharge position, means to disengage said detent means upon the insertion of a disk onto said disk carrier, said means to disengage said detent means including a lug on said disk carrier with said lug having a cam surface formed thereon, and a transversely extending line of weakness formed in said disk carrier, said cam surface being located so that a disk pushed thereagainst will bend said disk carrier about said line of weakness to move said ears off said ledges and onto said ramps so that said disk carrier can be moved by said handle to said disk discharge position.

* * * * *